US008292659B2

(12) United States Patent
Tuin

(10) Patent No.: US 8,292,659 B2
(45) Date of Patent: Oct. 23, 2012

(54) ELECTRICAL CONNECTOR

(75) Inventor: Jacobus Nicolaas Tuin, Best (NL)

(73) Assignee: Tyco Electronics Nederland B.V., AG's-Hertogenbosch (NL)

( * ) Notice: Subject to any disclaimer, the term of this patent is extended or adjusted under 35 U.S.C. 154(b) by 470 days.

(21) Appl. No.: 12/160,926

(22) PCT Filed: Jan. 19, 2007

(86) PCT No.: PCT/EP2007/000469

§ 371 (c)(1),
(2), (4) Date: Jul. 15, 2008

(87) PCT Pub. No.: WO2007/082763

PCT Pub. Date: Jul. 26, 2007

(65) Prior Publication Data

US 2010/0178811 A1 Jul. 15, 2010

(30) Foreign Application Priority Data

Jan. 20, 2006 (EP) ..... 06001202

(51) Int. Cl.
*H01R 13/60* (2006.01)

(52) U.S. Cl. ..... 439/540.1; 439/607.11; 439/701; 439/607.1

(58) Field of Classification Search ..... 439/626, 439/656, 658, 660, 701, 709, 712, 715–717, 439/607.06–607.11, 540.1
See application file for complete search history.

(56) References Cited

U.S. PATENT DOCUMENTS

| | | | | |
|---|---|---|---|---|
| 6,648,689 | B1 | 11/2003 | Billman et al. | |
| 6,851,954 | B2 * | 2/2005 | Ashman et al. | 439/701 |
| 7,182,608 | B2 * | 2/2007 | Soh et al. | 439/540.1 |
| 2002/0014675 | A1 | 2/2002 | Matsumoto et al. | |
| 2007/0004287 | A1 * | 1/2007 | Marshall | 439/701 |

FOREIGN PATENT DOCUMENTS

| | | | |
|---|---|---|---|
| EP | 0 422 785 | B1 | 3/1995 |
| JP | 07161414 | | 6/1995 |
| WO | 01/57964 | A1 | 8/2001 |
| WO | 02/095878 | A1 | 11/2002 |

OTHER PUBLICATIONS

PCT International Preliminary Report on Patentability dated Apr. 11, 2008.

* cited by examiner

*Primary Examiner* — Felix O Figueroa
(74) *Attorney, Agent, or Firm* — Barley Snyder

(57) ABSTRACT

An electrical connector includes a male electrical connector and a female electrical connector. The male electrical connector includes an electrical connector housing that receives a plurality of contact modules provided with first mating contacts. The female electrical connector includes an electrical connector housing that receives a plurality of contact modules provided with second mating contacts that mate with the first mating contacts. Each of the electrical connector housings has a plurality of electrically insulating plates. The electrically insulating plates extend in a plane substantially perpendicular to a plane of insertion of the contact modules into the electrical connector housings. The electrically insulating plates support at least the first mating contacts.

12 Claims, 13 Drawing Sheets

ELECTRICAL CONNECTOR

CROSS-REFERENCE TO RELATED APPLICATIONS

This application claims the benefit of the filing date under 35 U.S.C. §120 of International Patent Application No. PCT/EP2007/000469 filed Jan. 19, 2007 that claims the priority of European Patent Application No. EP 06 001 202.8 filed Jan. 20, 2006.

FIELD OF THE INVENTION

The present invention relates to electrical connectors and, in particular, to an electrical connector housing comprising a contact module insertion face for inserting a plurality of contact modules into the electrical connector housing, thereby forming an electrical connector, wherein each contact module comprises a plurality of first mating contacts for mating with a plurality of second mating contacts of a corresponding electrical connector, and a mating face for introducing said plurality of second mating contacts of said corresponding electrical connector into said electrical connector housing, thereby allowing said first mating contacts and second mating contacts to mate with each other.

BACKGROUND

With the ongoing trend towards smaller, faster and higher performance electrical components, such as a processor used in computers, routers, switches, etc., it has become increasingly important for the electrical interfaces along the electrical path to also operate at higher frequencies and at higher densities with increased throughput.

In a traditional approach for interconnecting circuit boards, one circuit board serves as a backplane and the other as a daughter board. The backplane typically has a connector, commonly referred to as a header that includes a plurality of signal pins or contacts, which connect to conductive traces on the backplane. The daughter board connector, commonly referred to as a receptacle, also includes a plurality of contacts or pins. Typically, the receptacle is a right angle connector that interconnects the backplane with the daughter board so that signals can be routed between the two. The right angle connector typically includes a mating face that receives the plurality of signal pins from the header on the backplane and a mounting face that connect to the daughter board. Likewise, the header comprises a mating face adapted to mate with the mating face of the right angle connector and a mounting face that connects to the backplane board.

As the transmission frequencies of signals through these connectors increase, it becomes more desirable to maintain a desired impedance through the connector to minimize signal degradation. A ground shield is sometimes provided on the module to reduce interference or crosstalk. In addition, a ground shield may be added to the ground contacts on the header connector. Improving connector performance and increasing contact density to increase signal carrying capacity without increasing the size of the connectors is challenging.

Some older connectors, which are still in use today, operate at speeds of one gigabit per second or less. In contrast, many of today's high performance connectors are capable of operating at speeds of up to 10 gigabits or more per second. As would be expected, the higher performance connector also comes with a higher cost.

When trying to design an electrical connector having a reduced pitch between signal pins, so as to obtain an electrical connector with a reduced size or with an increased pin density, the signal pins are made thinner and are therefore more fragile and likely to be bent or broken. When these electrical connectors are implemented in high-speed applications involving high transmission data rates, it is crucial to guarantee a high degree of electrical performance. However, the impedance and other important electrical properties of an electrical connector are dependent on the geometrical arrangement of the signal pins with respect to one another. Hence, it is challenging to design an electrical connector having a smaller pitch between its contacts, while guaranteeing high electrical performance.

Another problem, which might occur in electrical connectors, is that the contacts in the housing of the electrical connector, in particular the resilient parts that are located at the end of the electrical contacts, may be inaccurately positioned. This inaccurate positioning is considered a failure mechanism according to the electrical connector qualification tests used for telecommunication connectors such as Telcordia GR-1217-Core in the American market. This inaccurate positioning of the resilient part of the electrical contacts within one electrical connector can occur during production, handling, insertion, board handling, mating, etc. Furthermore, interferences may result that cause deviations from the contact normal force that has been originally designed. Moreover, the contact normal force may also decay with time due to stress relaxation or deformations of the resilient parts of the electrical contacts or deformations of the plastic connector parts of the housing. If the contact normal force is reduced to low levels, any additional decrease could be unacceptable and the contact normal force may reach critical minimum values.

An impedance matched backplane connector is disclosed in European patent EP 0 422 785 B1, wherein an electrical connection system includes a plurality of housing modules, each of the modules including a front mating face having a plurality of pin receiving passageways. In order to assemble the connector assembly, a plurality of terminal subassemblies is foreseen, each terminal subassembly being inserted into the rear of the housing modules, such that the terminal subassemblies are each stacked one against the other. The terminal subassemblies comprise electrical contacts in the form of blade sections that, when the terminal subassemblies are inserted into the housing modules, are aligned with vertical slots arranged in the rear of the housing modules, thereby disposing the plurality of opposed contact portions of the terminal lead frames adjacent to the narrow aperture at the front mating face of the connector.

However, in the connector assembly disclosed in the European patent mentioned above, the electrical contacts within the male electrical connector are not fully supported. Hence, in the case of thin electrical contacts, which are more fragile, and may thus break easily, the electrical connector is not very reliable and has a relatively short lifetime. Furthermore, the female connector disclosed therein is based on a double-beam contact principle, i.e. two female contacts mating with one male electrical contact. Such a two-contact female connector interface however presents the technical drawback that the contact normal force is often reduced to critical minimum values.

Other contact failure mechanisms involved in electrical connector designs in the art is the deposition of dust or particulates on contact surfaces, connector wear or gaseous corrosion of exposed non-noble metals out of which the contacts may be made.

SUMMARY

A first object of the invention is to provide an improved electrical connector housing that allows for obtaining a particularly reliable electrical connector having reduced contact failures.

A second object of the invention is to provide an electrical connector having a reduced pitch between its contacts as well as improved electrical characteristics, while guaranteeing a reduced production complexity.

When a plurality of electrically insulating plates are formed integrally with the electrical connector housing and are adapted to support the first mating contacts, the first mating contacts are securely supported by such an electrical connector housing and a particularly robust electrical connector can thus be produced. Since the first mating contacts of the electrical connector are thin and thus quite exposed to deformation or damages, the construction of the electrical connector housing according to the invention is particularly advantageous, as it allows for a very stable geometry that guarantees a good protection of the first mating contacts. Further, the electrically insulating plates allow for keeping a constant pitch between the first mating contacts, thus also guaranteeing a fixed geometry and uniform electrical properties.

Since the plurality of electrically insulating plates are formed integrally with the electrical connector housing, the contacts in the electrical connector housing are fully protected and an inaccurate positioning of the resilient parts of the contacts within the electrical connector housing during production, handling, insertion, board handling, mating, etc. can be avoided. Furthermore, since the contacts in the electrical connector housing can be accurately positioned, the signal transmission quality can be improved and a contact normal force can be maintained to an acceptable minimum value, so as to not compromise signal transmission quality. Moreover, a deformation of the resilient part of the contacts, as well as plastic deformations of the plastic housing, can be avoided.

According to an embodiment of the electrical connector housing, at least one of the plurality of electrically insulating plates comprises a plurality of spacers that are arranged on a surface thereon at predetermined intervals from one another, said spacers separating two adjacent second mating contacts of two adjacent contact modules from one another. Hence, two adjacent second mating contacts are separated electrically from one another and a strong T-shaped housing wall can thus be formed between two adjacent contacts.

According to an embodiment of the electrical connector housing, the spacers are such that the second mating contact of an inserted contact module and a surface of a spacer form a lead-in for introducing the first mating contact of the corresponding electrical connector. Consequently, the first mating contact of the electrical connector and the corresponding second mating contact of the corresponding electrical connector are enclosed between two adjacent spacers, thereby providing for a very secure mechanical mating between the first and second mating contacts of the two respective electrical connectors. Further, a closed box structure is achieved, which allows for preventing dust or particles from entering into the electrical connector housing and for limiting connector wear, as vibrations can be avoided.

According to yet another embodiment of the invention, said second mating contact comprises a curved resilient end and said spacer comprises an end that is carved out to enable an easier introduction of said first mating contact.

According to yet another embodiment of the invention, at least one of the plurality of electrically insulating plates comprises supporting ribs that are formed on a surface thereof and are adapted to support the first mating contacts that are inserted in the electrical connector housing so that the first mating contacts are pressed against the supporting ribs, a longitudinal axis of the supporting ribs being essentially parallel to a longitudinal axis of the first mating contacts. Foreseeing supporting ribs provides the technical advantage that the connector assembly can be rendered less fragile by supporting the first mating contacts arranged on the electrically insulating plates. Furthermore, the supporting ribs allow for positioning the tip of the first mating contacts by serving as a guide.

According to another embodiment of the invention, the electrical connector housing is adapted to accommodate a second electrical connector housing of the corresponding electrical connector and further comprises guiding ribs that are adapted to be inserted into corresponding guiding slots arranged in the second electrical connector housing of the corresponding electrical connector. The respective housing of the electrical connector and corresponding electrical connector can thus be connected with one another in a smooth manner.

According to another embodiment of the electrical connector according to the invention, the plurality of mounting contacts are arranged in a matrix of rows and columns and a pitch between two mounting contacts arranged in a same column has a value that alternates between two different values. This allows for providing enough space between the mounting contacts in order to route tracks between them when the mounting contacts are mounted on a printed circuit board, while guaranteeing an overall reduced pitch between contacts.

According to yet another embodiment of the invention, the plurality of mating contacts is foreseen with different possible lengths, which allows for different types of electrical connectors to be produced that may be implemented in different applications, thus allowing for a high degree of flexibility.

It is also particularly advantageous to foresee an electrical connector, wherein the plurality of mounting contacts and first mating contacts are arranged in a plurality of chicklets that are connectable to the connector housing, preferentially by clipping. The chicklets can be very easily connected to the connector housing to form a female connector. Chicklets can be manufactured in a very cost-effective manner by overmolding the mounting contacts and mating contacts with preferentially a plastic material.

DETAILED DESCRIPTION OF THE EMBODIMENT(S)

Figure 1:
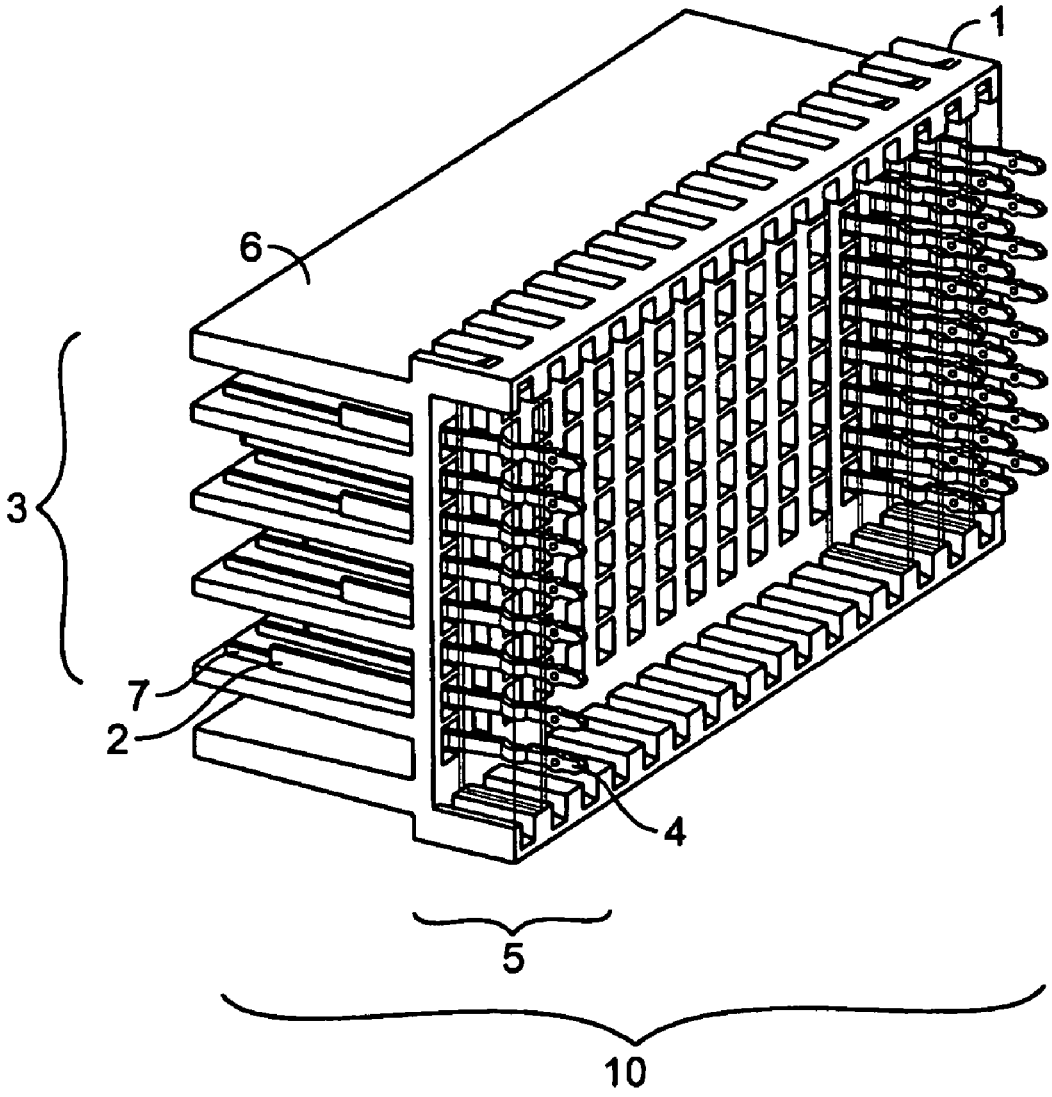
FIG. 1 is a perspective view of a male electrical connector according to an embodiment of the invention.

FIG. 1 shows a perspective view of a male electrical connector 10 according to an embodiment of the invention. A plurality of contact modules 5 (a few of them being represented in phantom lines in FIG. 1) is inserted into an electrical connector housing 1, thereby forming the male electrical connector 10. The term "chicklet" is also often used in the art to refer to the contact module 5. Thus, the two terms will be used in the present application.

In each of the contact modules 5, a plurality of first mating contacts 2 define a forward mating edge 3. Each of the first mating contacts 2 is electrically connected to a corresponding mounting contact 4. The plurality of the mounting contacts 4 define a mounting edge. The electrical connector housing 1 is made out of an electrically insulating material, preferentially a plastic material. The plurality of the first mating contacts 2 protrude through a plurality of cavities provided in the electrical connector housing 1.

A plurality of the mounting contacts 4 are arranged in each of the contact modules 5, wherein the mounting contacts 4 are aligned with respect to each other and over-molded in the contact module 5 with a distance between each other that is essentially constant. However, it may also be considered to over-mold the mounting contacts 4 with a distance between the mounting contacts 4 this is alternating between two different values or following a different pattern.

Figure 2:
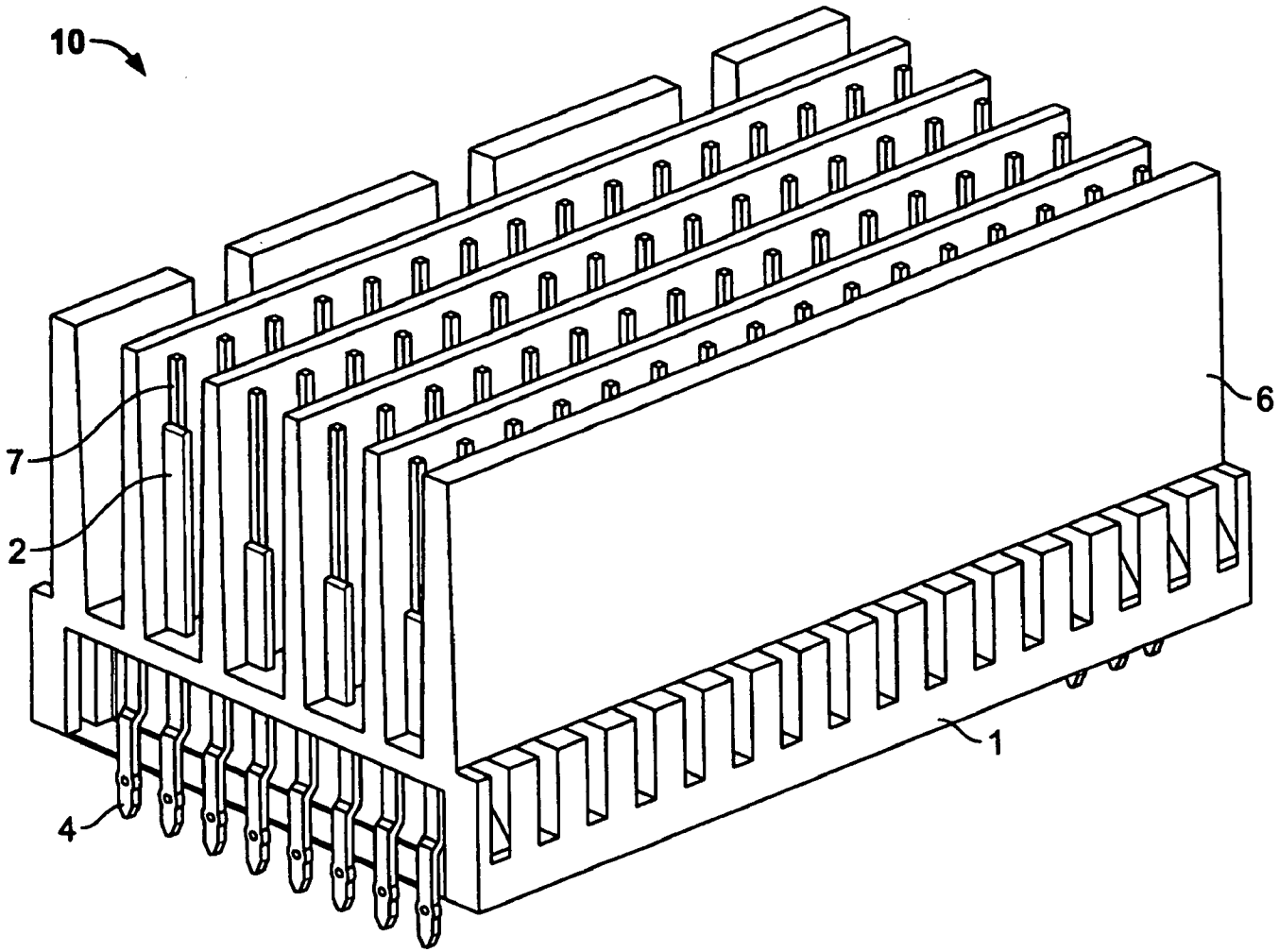
FIG. 2 is a further perspective view of the male electrical connector shown in FIG. 1.
Figure 3:
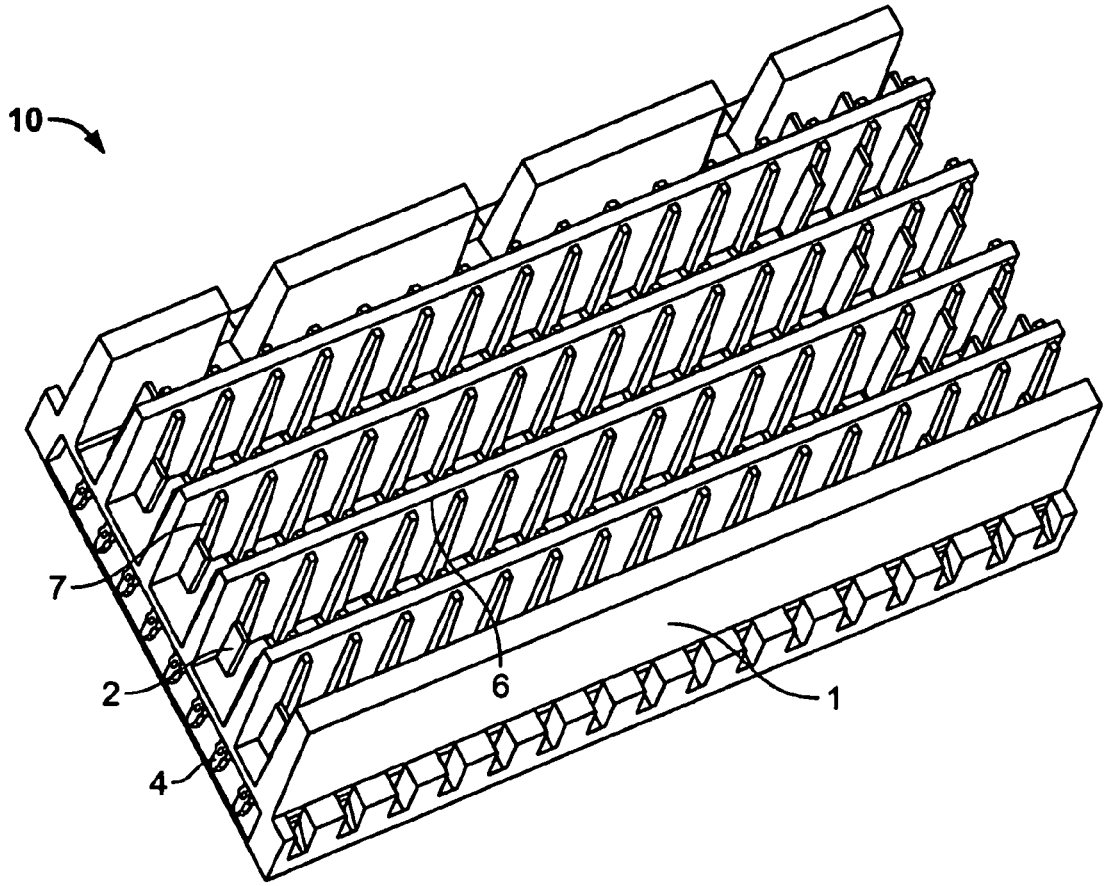
FIG. 3 is another perspective view of the male electrical connector shown in FIG. 1.

The electrical connector housing 1 comprises a plurality of electrically insulating plates 6, preferentially made out of a plastic material, that are formed integrally with the electrical connector housing 1. The electrically insulating plates 6 are arranged preferentially parallel to each other and support the first mating contacts 2. According to a preferred embodiment of the invention, supporting ribs 7 may also be arranged at the surface of the electrically insulating plates 6. The supporting ribs 7 are arranged on the electrically insulating plates 6 of the electrical connector housing 1 so that a longitudinal axis of the first mating contacts 2 is essentially parallel to a longitudinal axis of the supporting ribs 7. The first mating contacts 2 are arranged in the electrical connector housing 1 so that the first mating contacts 2 are pressed against the supporting ribs 7. The first mating contacts 2 thus lay on the supporting ribs 7 with a slight pre-load. The width of the supporting ribs 7 corresponds to a fraction of the width of the first mating contacts 2, so that a portion of the first mating contacts 2 is pressed against the supporting ribs 7. FIGS. 2 and 3 show two further perspective views of the male electrical connector 10 according to an embodiment of the invention.

Figure 4:
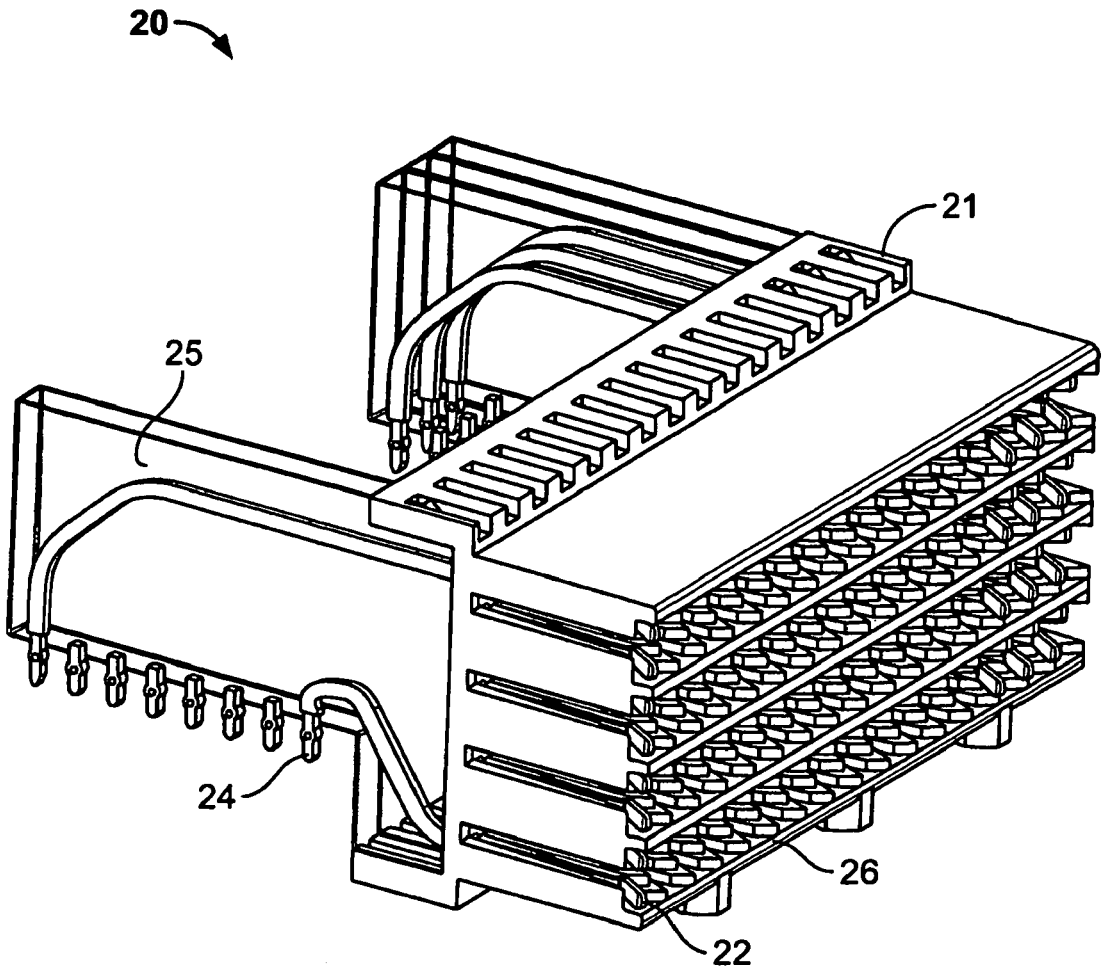
FIG. 4 is a perspective view of a female electrical connector according to another embodiment of the invention.

FIG. 4 is a perspective view of a female electrical connector 20 according to another embodiment of the invention. The female electrical connector 20 comprises an electrical connector housing 21 in which a plurality of the contact modules 25 are inserted. Each of the contact modules 25 comprises a plurality of electrical contacts having a first extremity being a second mating contact 22 and a second extremity being a mounting contact 24. The plurality of the second mating contacts 22 are electrically connected to the plurality of the mounting contacts 24. The plurality of the second mating contacts 22 define a mating edge, and the plurality of the mounting contacts 24 define a mounting edge. The electrical connector housing 21 is formed out of an electrically insulating material, preferentially out of plastic material.

The electrical connector housing 21 comprises a plurality of electrically insulating plates 26 that are formed integrally with the electrical connector housing 21. The plurality of the second mating contacts 22 are arranged on the surface of the plurality of the electrically insulating plates 26 and are thus supported by the electrically insulating plates 26.

According to an embodiment of the invention, the electrically insulating plates 26 may further comprise a plurality of spacers 29 that are arranged on a surface of the electrically insulating plates 26 at predetermined intervals from one another. The spacers 29 are arranged on the electrically insulating plates 26 in such a way that the spacers separate two adjacent second mating contacts 22 of two adjacent contact modules 25 from one another, when the contact modules 25 are inserted into the electrical connector housing 21. The second mating contact 22 and a surface of the spacer 29 separating the second mating contact 22 from an adjacent second mating contact 22 of an adjacent contact module 25 form a lead-in for introducing the first mating contact 2 of the male electrical connector 10. This will be explained in more detail in the following.

Figure 5:
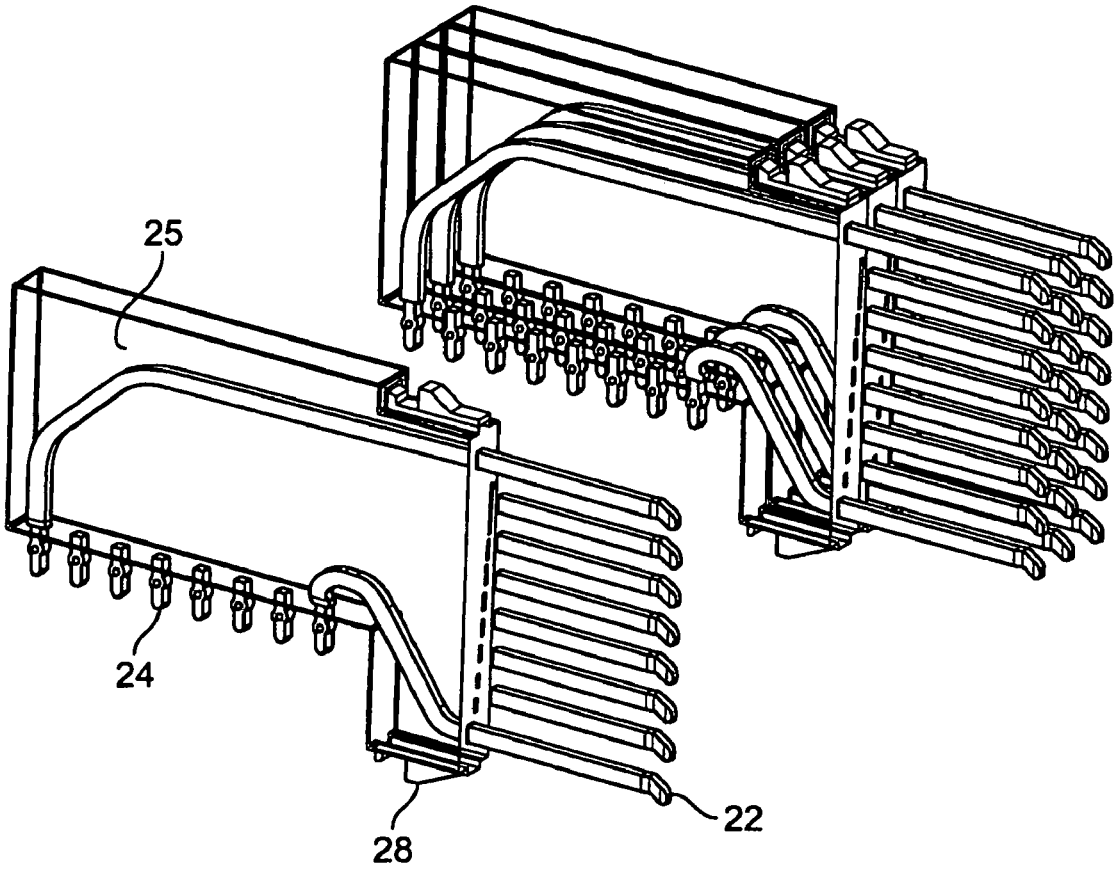
FIG. 5 is a perspective view of a plurality of contact modules of the female electrical connector.

FIG. 5 shows a perspective view of the plurality of the contact modules 25 in which the second mating contacts 22 and the mounting contacts 24 are arranged. The plurality of the contact modules 25 are connectable to the electrical connector housing 21, preferentially by clipping, thus forming the female electrical connector 20. In the exemplary embodiment shown in FIG. 5, the contact module 25 comprises clipping elements 28 for clipping into the electrical connector housing 21.

Figure 6:
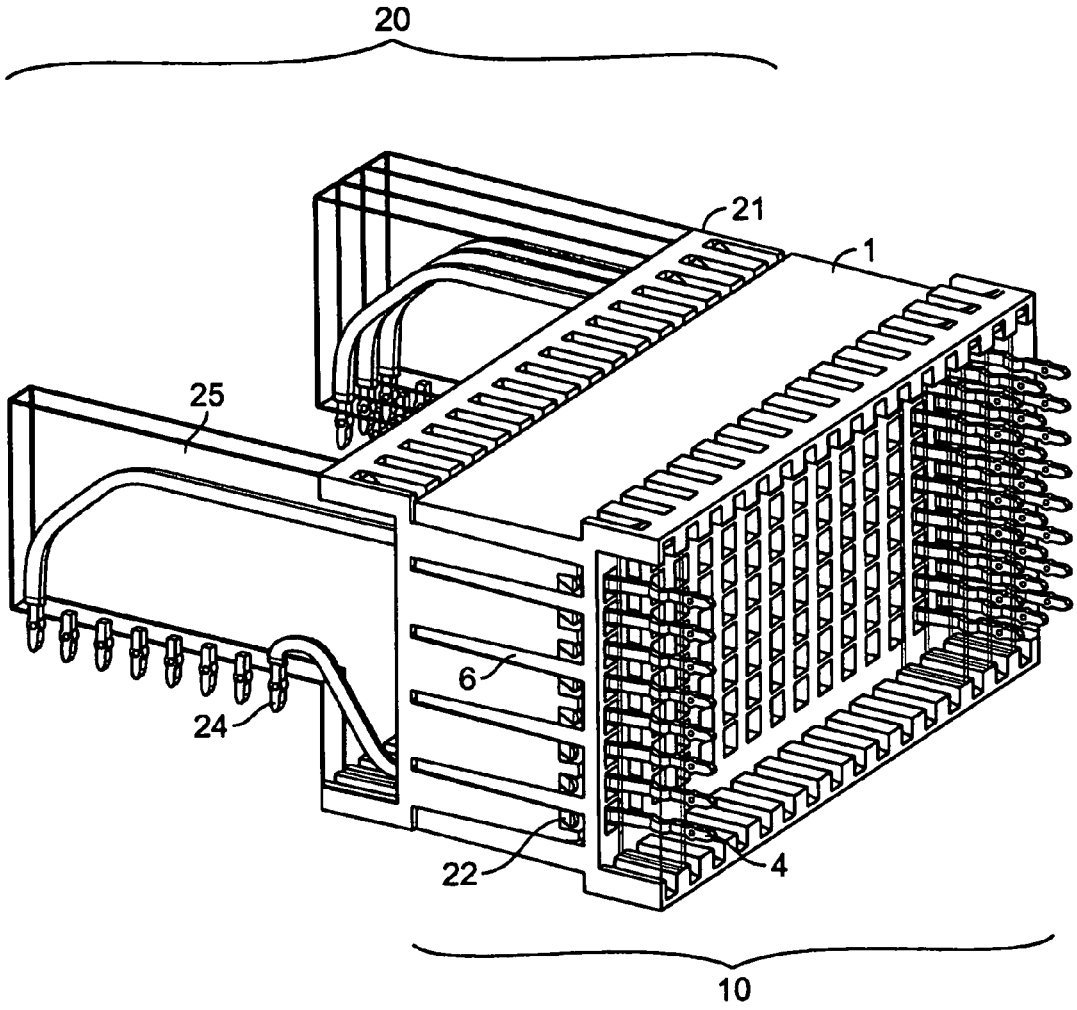
FIG. 6 is a perspective view of the male electrical connector and the female electrical connector according to an embodiment of the invention in a connected position.

FIG. 6 is a perspective view of the male electrical connector 10 according to an embodiment of the invention connected with the female electrical connector 20 according to another embodiment of the invention. The electrical connector housing 1 of the male electrical connector 10 is accommodated in the electrical connector housing 21 of the female electrical connector 20. The plurality of the first mating contacts 2 arranged in the cavities of the electrical connector housing 1 of the male electrical connector 10 are mated with the second mating contacts 22 arranged in the electrical connector housing 21 of the female electrical connector 20.

Figure 7:
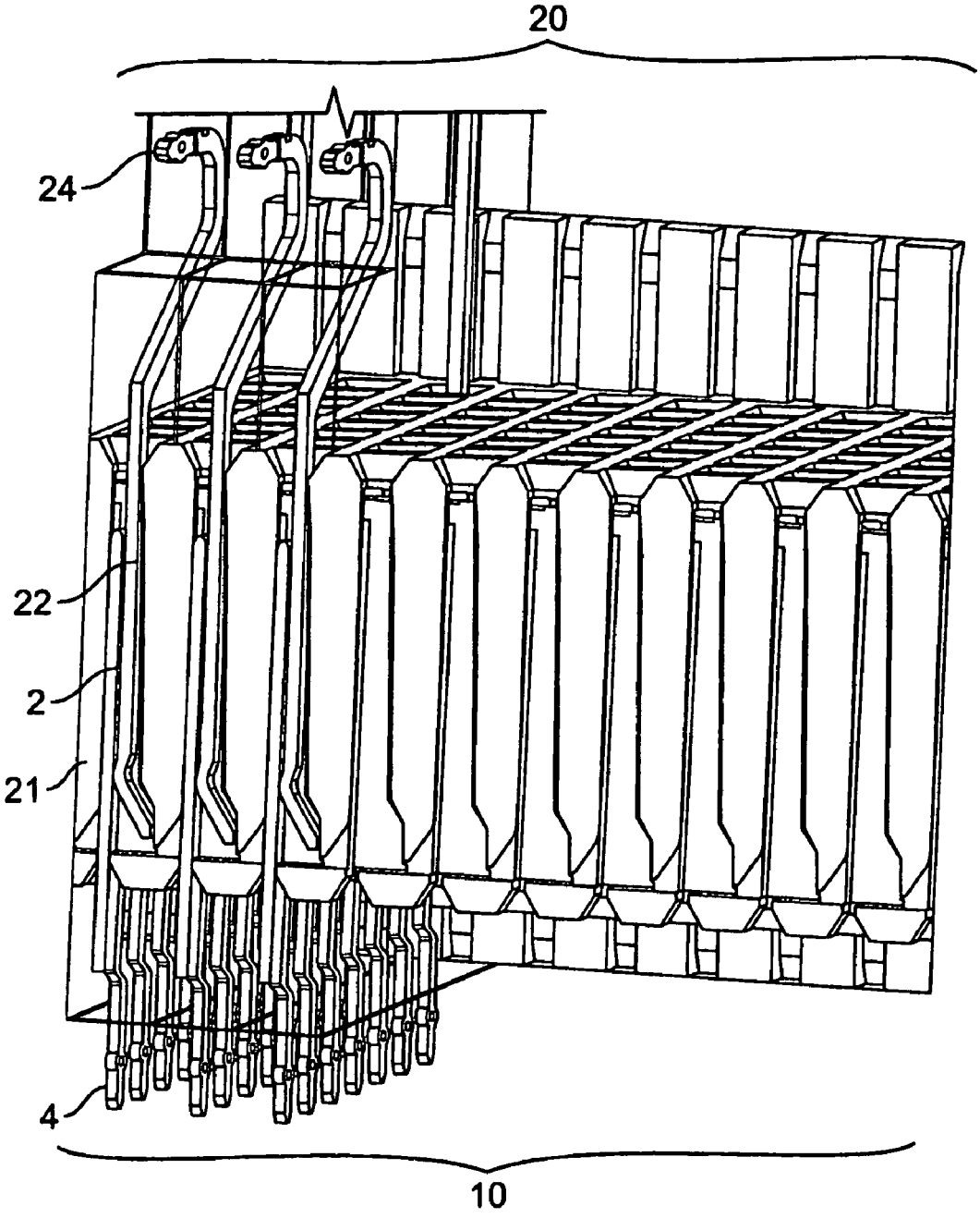
FIG. 7 is a perspective view of a cross-section taken through the assembly of the male electrical connector and the female electrical connector in a connected position.

FIG. 7 shows a cross-section through the assembly of the male electrical connector 10 and the female electrical connector 20 in a connected position. The second mating contact 22 of the female electrical connector 20 and the surface of the spacer 29, that is arranged adjacent to the second mating contact 22 and separates the second mating contact 22 from an adjacent second mating contact 22 of an adjacent contact module 25, form a lead-in for the first mating contact 2 of the male electrical connector 10. After being inserted into the lead-in, the first mating contacts 2 of the male electrical connector 10 are thus clamped between the spacers 29 arranged on the electrically insulating plates 26 of the female electrical connector 20 and the corresponding second mating contact 22 of the female electrical connector 20. A cross-section through the spacers 29 is represented in FIG. 7 that shows the first mating contacts 2 that are clamped between the spacers 29 and the second mating contacts 22.

Figure 8:
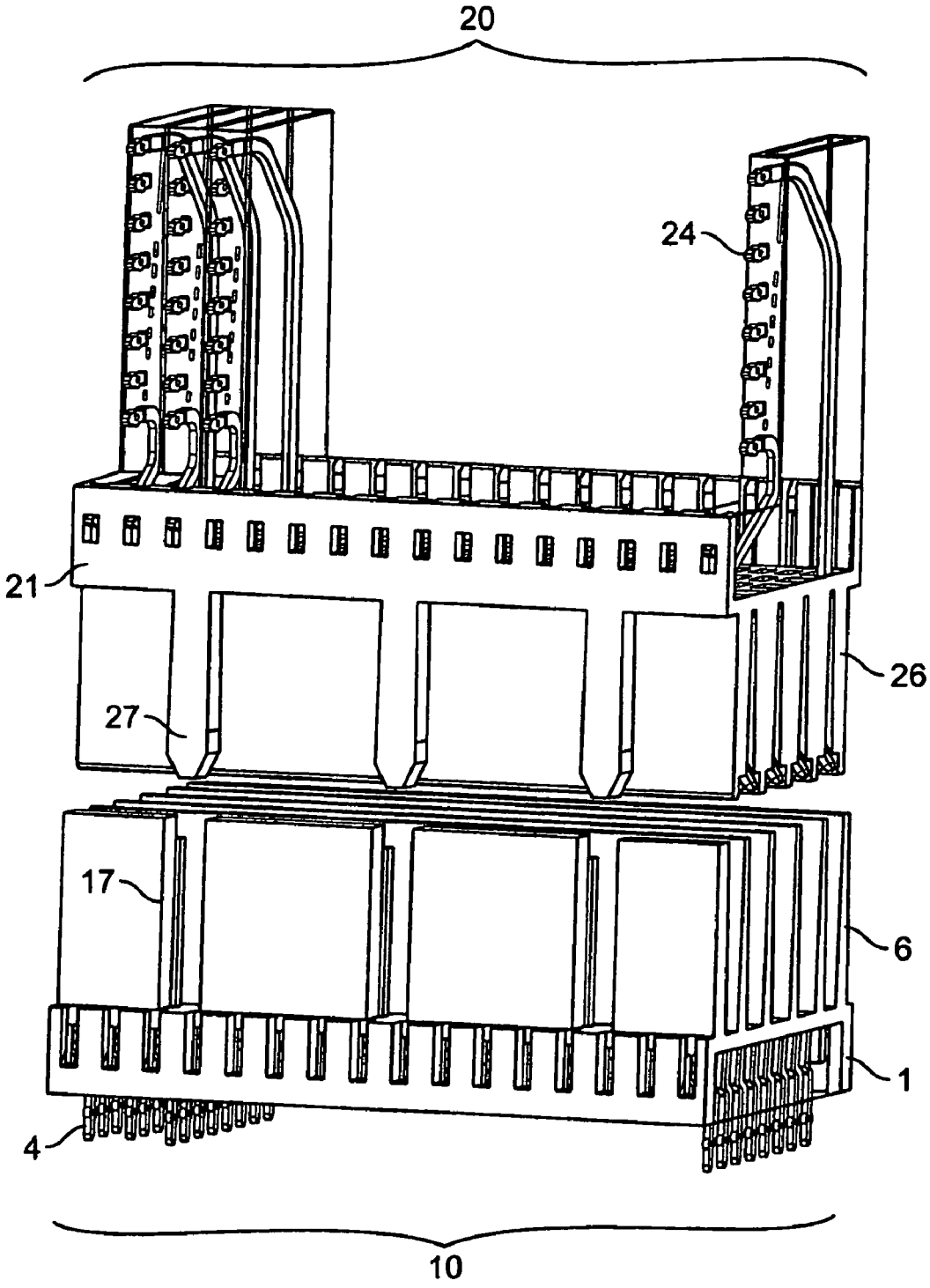
FIG. 8 is a perspective view of the male electrical connector and the female electrical connector before connection.

FIG. 8 is a perspective view of the male electrical connector 10 and the female electrical connector 20 according to an embodiment of the invention, shown in a position before connection of the male electrical connector 10 with the female electrical connector 20. The male electrical connector 10 comprises guiding slots 17 that are integrated in the electrical connector housing 1. The female electrical connector 20 comprises guiding ribs 27 provided on the surface of the electrical connector housing 21. The guiding ribs 27 of the electrical connector housing 21 can be inserted into the corresponding guiding slots 17 of the male electrical connector 10 housing to facilitate the mating of the electrical connector housing 21 of the female electrical connector 20 with the electrical connector housing 1 of the male electrical connector 10.

Figure 9:
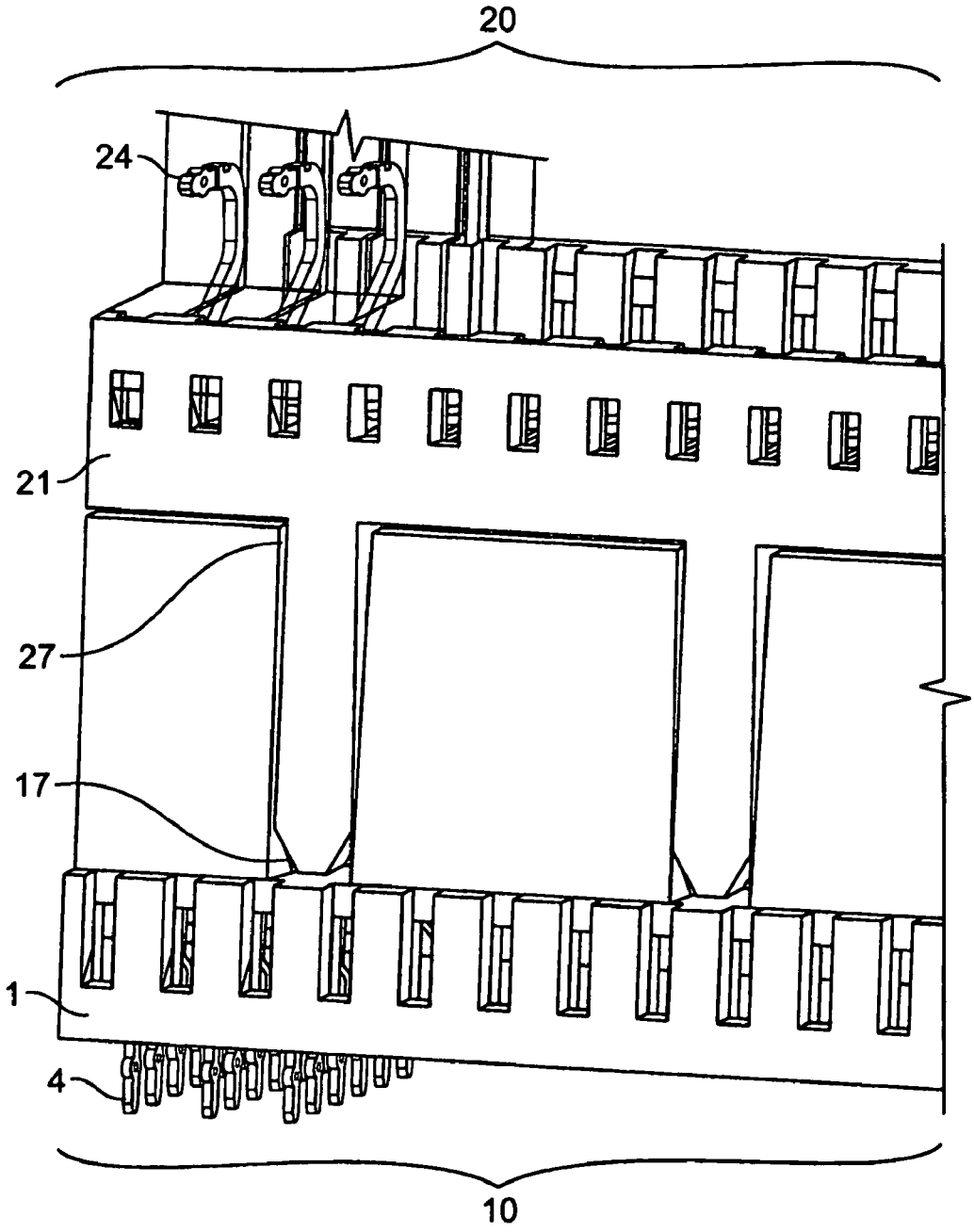
FIG. 9 shows the male electrical connector and the female electrical connector in a connected position.

FIG. 9 shows a perspective view of the male electrical connector 10 and the female electrical connector 20 in a connected position. The guiding ribs 27 of the electrical connector housing 21 are inserted into the corresponding guiding slots 17 of the electrical connector housing 1 of the male electrical connector 10. As apparent from FIG. 9, some room is foreseen in the guiding slots 17 to allow for an easier insertion of the guiding ribs 27.

Figure 10:
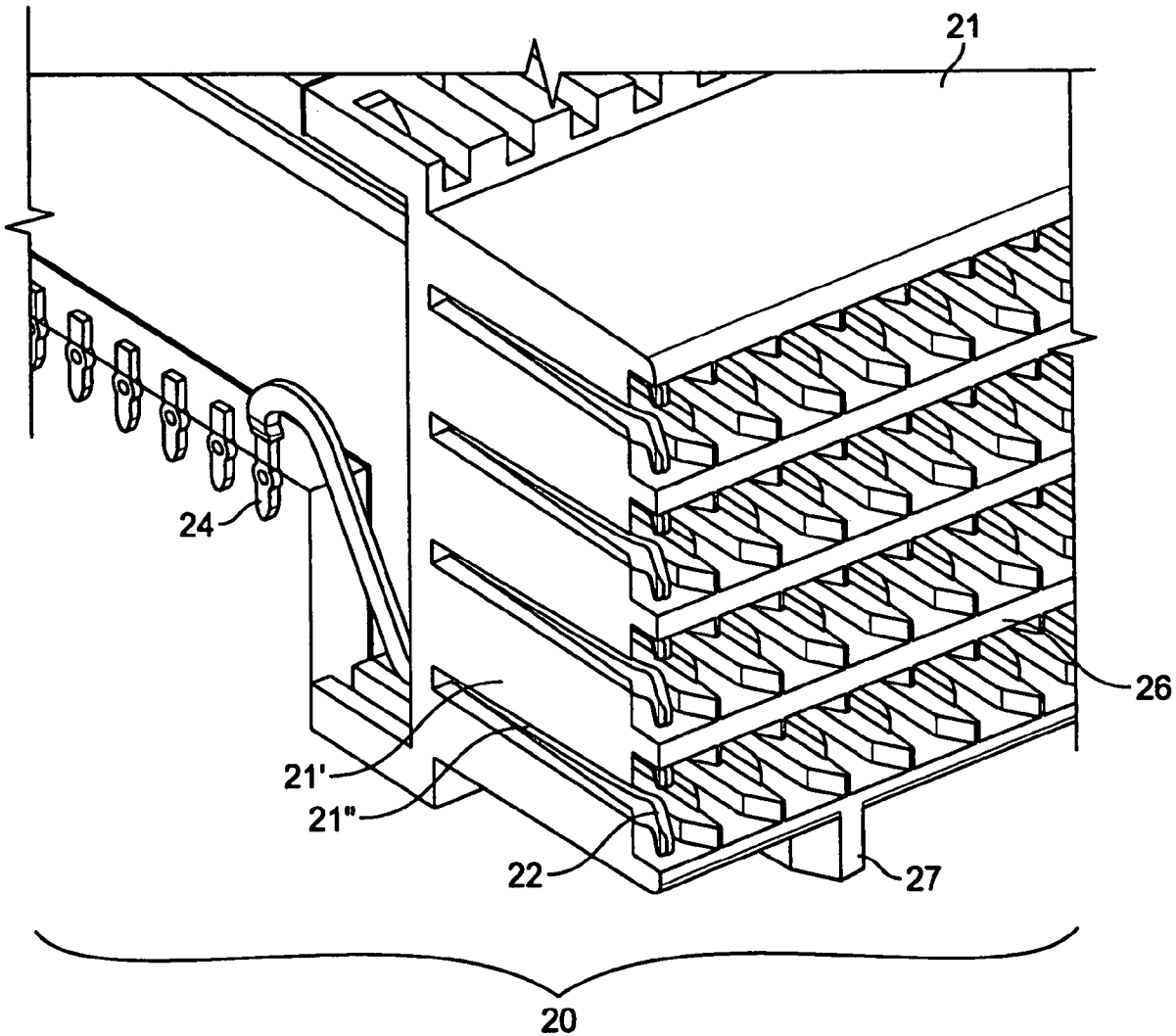
FIG. 10 is a perspective view of the female electrical connector according to an embodiment of the invention.

FIG. 10 is a perspective view of the female electrical connector 20. The second mating contacts 22 are arranged within the electrical connector housing 21. A side wall 21' of the electrical connector housing 21 comprises recesses 21" in which the extremities of the electrically insulating plates 6 of the electrical connector housing 1 of the male electrical connector 10 can be inserted, as is apparent from FIG. 6. The spacers 29 arranged on the electrically insulating plates 26 are shown to be in contact with the pre-loaded second mating contacts 22. The second mating contacts 22 comprise a curved resilient end and the spacers 29 comprise ends that are carved out, so that an introduction of the first mating contact 2 of the male electrical connector 10 is facilitated, as a lead-in is formed by the carved out end of the spacer 29 and the curved resilient end of the adjacent second mating contact 22.

Figure 11:
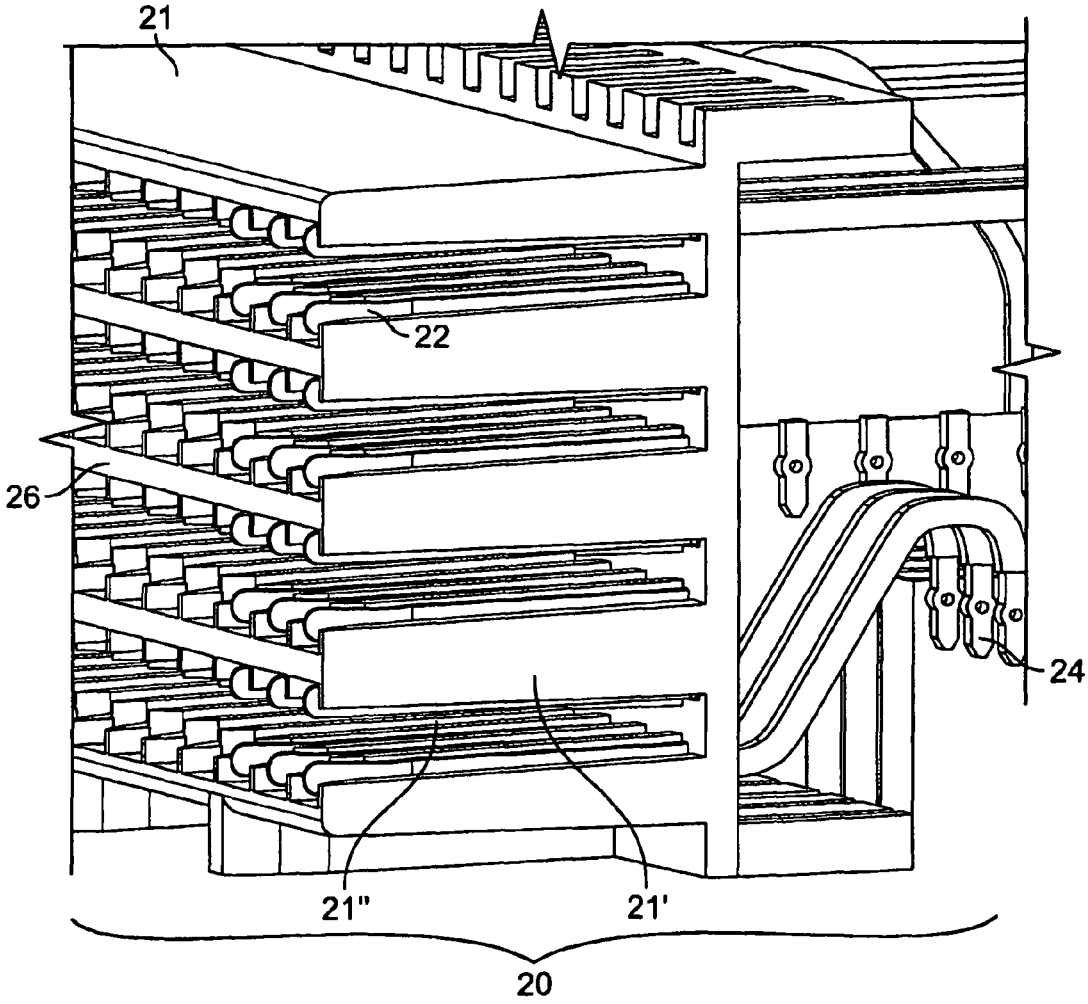
FIG. 11 is another perspective view of the female electrical connector shown in FIG. 10.

FIG. 11 is another perspective view of the female electrical connector 20, which shows the recesses 21" in the side wall 21' of the electrical connector housing 21 of the female electrical connector 20.

Figure 12:
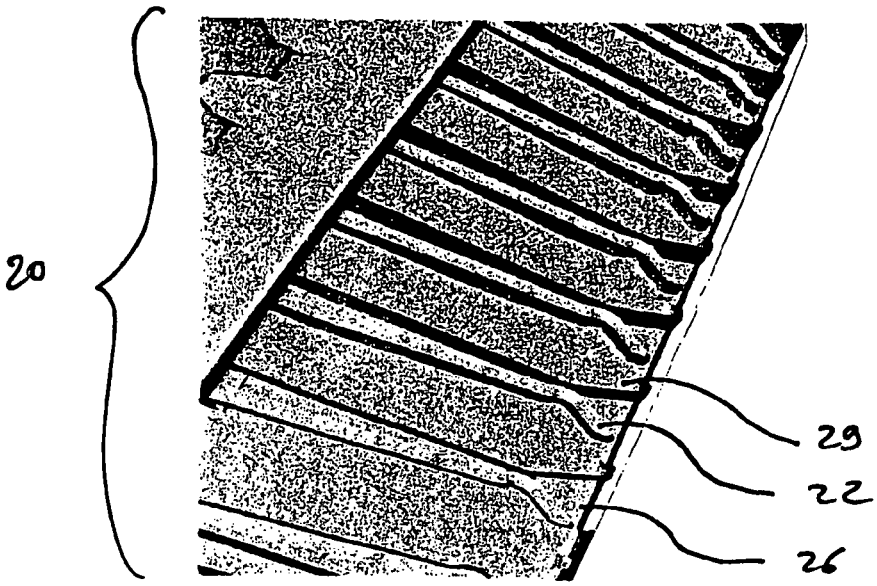
FIG. 12 shows a perspective view of a portion of the female electrical connector before connection with the male electrical connector.

FIG. 12 shows a perspective view of a portion of a cross section through the female electrical connector 20 showing the spacers 29 arranged at a predetermined distance from one another on one of the electrically insulating plates 26. It shows that the surface of the spacer 29 and the adjacent second mating contact 22 form a lead-in for introducing the first mating contact 2 of the male electrical connector 10.

Figure 13:
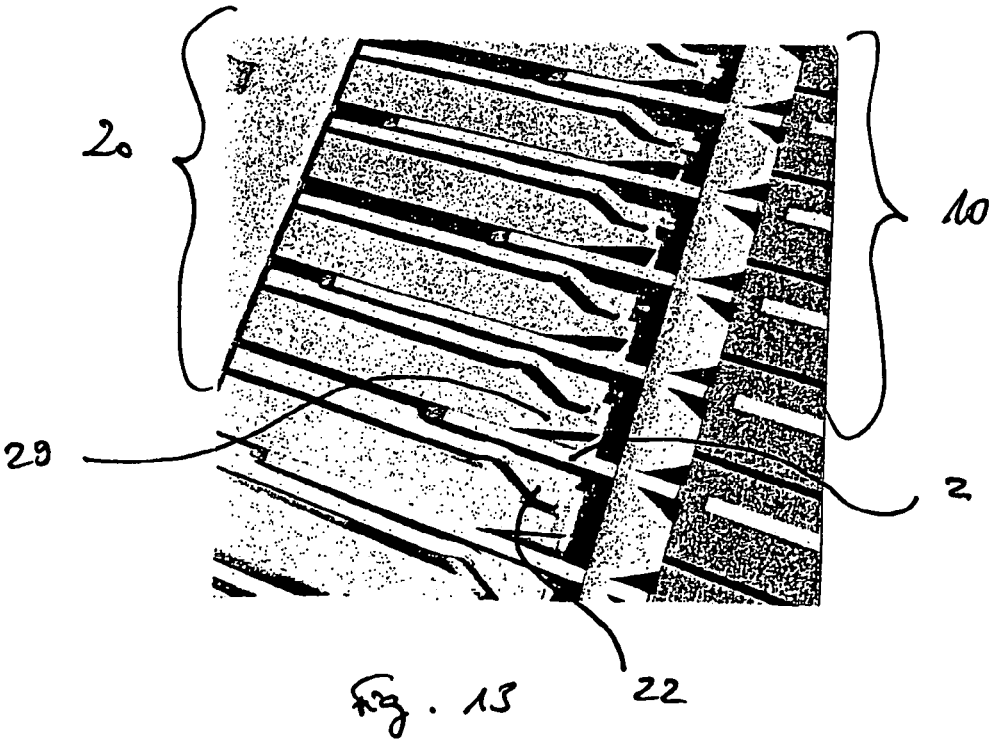
FIG. 13 shows a perspective view of the portion of the female electrical connector shown in FIG. 12 after connection with the male electrical connector.

FIG. 13 shows a similar view as in FIG. 12, after the second mating contacts 22 of the female electrical connector 20 have mated with the corresponding first mating contacts 2 of the male electrical connector 10. It is apparent from FIG. 13 that the first mating contacts 2 are clamped between the second mating contacts 22 and the surface of an adjacent one of the spacers 29.

Figure 14:
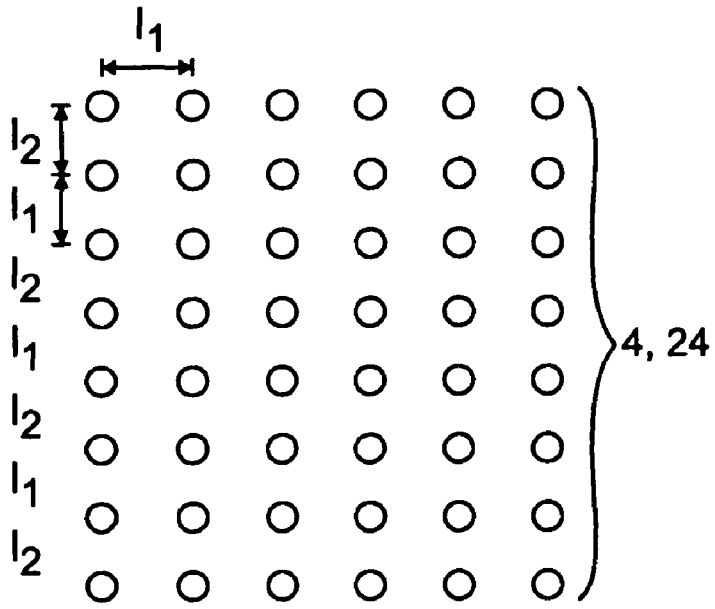
FIG. 14 shows a matrix arrangement of the mounting contacts of the female electrical connector or the male electrical connector according to an embodiment of the invention.

FIG. 14 shows the arrangement of the mounting contacts 4, 24 of the male or female electrical connector 10, 20. FIG. 14 shows a cross-section through the set of the mounting contacts 4, 24 and shows the matrix arrangement of the mounting contacts 4, 24 in rows and columns. A row pitch $\mathbf{1}_1$ between two adjacent mounting contacts 4, 24 arranged in the same row has a constant value. On the other hand, a column pitch between two adjacent mounting contacts 4, 24 arranged in a same column has an alternating value. The column pitch between two adjacent mounting contacts 4, 24 has an alternating value that is one of two values $l_1$ and $l_2$.

Figure 15:
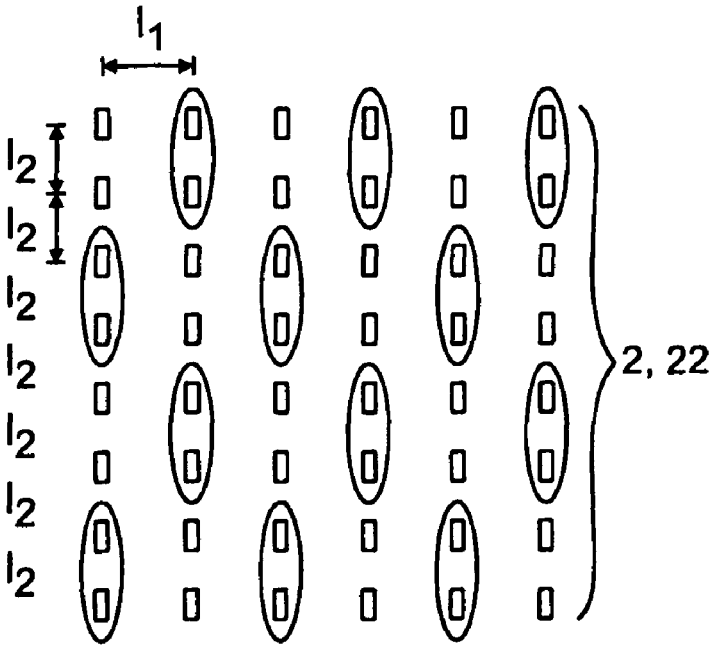
FIG. 15 shows a matrix arrangement of the mating contacts in the female electrical connector or the male electrical connector according to an embodiment of the invention.

FIG. 15 shows the matrix arrangement of the first and second mating contacts 2, 22 of the male or female electrical connector 10, 20. A row pitch between two adjacent first and second mating contacts 2, 22 arranged in a same row has a constant value $l_1$. A column pitch between two adjacent first and second mating contacts 2, 22 arranged in a same column has a constant value $l_2$.

In a preferred embodiment of the invention, the pitch value $l_1$ has a value comprised between 1.25 millimeter and 1.70 millimeter, while the pitch value $l_2$ has a value comprised between 1.00 millimeter and 1.50 millimeter.

Even though the column pitch between two adjacent mounting contacts 4, 24 arranged in a same column has been described as having an alternating value in a preferred embodiment of the invention, the column pitch between two adjacent mounting contacts 4, 24 may also have a uniform value.

The female electrical connector 20 described herein comprises a plurality of electrically insulating plates 26 formed integrally with the electrical connector housing 21, wherein the plurality of the electrically insulating plates 26 are adapted to support the second mating contacts 22 of the female electrical connector 20. The electrical connector housing 21 according to an embodiment of the invention allows for an accurate positioning of the resilient parts of the second mating contacts 22 of the female electrical connector 20 within the electrical connector housing 21, thereby increasing the contact reliability of the electrical connector 20. The electrical connector housing 21 guarantees a long life time for the female electrical connector 20, as the contact normal forces can be maintained to values that are close to the originally designed values.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. An electrical connector, comprising:

a first electrical connector including an electrical connector housing that receives a plurality of contact modules and is provided with first mating contacts and integral guiding slots;

a second electrical connector including an electrical connector housing that receives a plurality of contact modules and is provided with second mating contacts that mate with the first mating contacts and guiding ribs arranged on a surface of the connector housing, the guiding ribs being insertable into corresponding guiding slots to facilitate mating of the first and second electrical connectors;

each of the electrical connector housings having a plurality of electrically insulating plates, each of the plurality of electrically insulating plates extending from one side of the first or second connector linearly to another side such that each of the plurality of electrically insulating plates are substantially parallel to and spaced from each other and extend in a plane substantially perpendicular to a plane of insertion of the contact modules into the electrical connector housings, the electrically insulating plates supporting at least the first mating contacts and a plurality of supporting ribs formed on a surface of the plurality of electrically insulating plates of the first connector such that the plurality of supporting ribs support the first mating contacts so that they are preloaded against the plurality of supporting ribs.

2. The electrical connector of claim 1, wherein the electrically insulating plates of the electrical connector housing of the second electrical connector include spacers arranged on a surface thereof at predetermined intervals from one another, the spacers separating the second mating contacts of two adjacent contact modules from one another.

3. The electrical connector of claim 2, wherein the spacer include a surface that forms a lead-in for introducing the first mating contacts.

4. The electrical connector of claim 3, wherein the second mating contacts have curved resilient ends and the surface of the spacers has an end that is carved out.

5. The electrical connector of claim 1, wherein the first mating contacts are pressed against the supporting ribs.

6. The electrical connector of claim 1, wherein the electrically insulating plates are plastic.

7. The electrical connector of claim 1, wherein the electrically insulating plates are integrally formed with the electrical connector housings.

8. The electrical connector of claim 1, wherein each of the first and second mating contacts is connected to a mounting contact.

9. The electrical connector of claim 8, wherein the mounting contacts are arranged in a matrix of rows and columns and a pitch between adjacent mounting contacts arranged in the same column has a value that alternates between two different values.

10. The electrical connector of claim 8, wherein the mounting contacts and the first mating contacts are over-molded to form the contact modules.

11. The electrical connector of claim 1, wherein the first mating contacts have different lengths.

12. The electrical connector of claim 1, wherein the first electrical connector is a male electrical connector and the second electrical connector is a female electrical connector.

* * * * *